United States Patent [19]

Van Ess

[11] 4,244,014

[45] Jan. 6, 1981

[54] LIGHT MOUNTING TAPES

[75] Inventor: John C. Van Ess, Chicago, Ill.

[73] Assignee: Walter A. Ross, Schiller Park, Ill.

[21] Appl. No.: 966,493

[22] Filed: Dec. 4, 1978

[51] Int. Cl.[3] ..... F21V 21/00

[52] U.S. Cl. ..... 362/249; 362/226

[58] Field of Search ..... 362/108, 219, 226, 249, 362/252, 806, 250–251; 24/16 PB, 17, 17 AP, 204; 40/541; 211/119.02, 119.13, 119.14, 89; 248/74, 74 A, 74 B, 110, 113, 505; 2/DIG. 6

[56] References Cited

U.S. PATENT DOCUMENTS

| | | | |
|---|---|---|---|
| 1,652,825 | 12/1927 | Hechinger | 211/26 |
| 1,820,706 | 8/1931 | Law | 211/119.14 |
| 1,853,261 | 4/1932 | Dawson | 211/89 |
| 2,318,375 | 5/1943 | Copeland | 211/119.13 |
| 2,462,562 | 2/1949 | Schwab | 362/226 |
| 2,676,711 | 4/1954 | Jardim | 211/119.02 |
| 2,722,317 | 11/1955 | Goodwin | 211/89 |
| 3,127,019 | 3/1964 | Von Meyer | 211/119.13 |
| 3,189,310 | 6/1965 | Trueson | 248/314 |
| 3,273,839 | 9/1966 | Bennett | 248/74 B X |
| 3,275,818 | 9/1966 | Campbell | 362/249 |
| 3,540,687 | 11/1970 | Cuva | 248/316 D |
| 3,894,225 | 7/1975 | Chao | 362/249 |

FOREIGN PATENT DOCUMENTS

| | | | |
|---|---|---|---|
| 2300731 | 7/1973 | Fed. Rep. of Germany | 248/74 PB |
| 1064464 | 5/1954 | France | 24/16 PB |

*Primary Examiner*—Richard A. Wintercorn
*Assistant Examiner*—Thomas H. Tarcza
*Attorney, Agent, or Firm*—Hill, Van Santen, Steadman, Chiara & Simpson

[57] ABSTRACT

A device for mounting ornamental electric light sockets, such as the type commonly used for Christmas decorations, has a flexible tape which is mounted to the structure to be illuminated. In one embodiment a plurality of extruded flanged ribs are spaced at equal intervals along one side of the tape. An elastic band stretched between adjacent ribs presses a light socket between the ribs and holds it substantially immovably in place. A second embodiment utilizing the ribbed tape has a strip having longitudinal slits disposed therein whose spacing is coordinated with that of the ribs, so that the ribs may be forced through the slits in the strip which then presses against a light socket between the ribs to hold it immovably in place. A third embodiment has a plurality of knobs having rounded heads spaced at equal intervals along one side of a tape, and a strip having holes therein whose spacing is coordinated with the spacing of the knobs, so that the knobs may be forced through the holes in the strip and thereby immovably secure a light socket between the knobs. A fourth embodiment is comprised of two pile type fastener strips, between which a light socket is placed, with the strips pressed together to interlock on either side of the light, thereby holding it in place. A fifth embodiment is comprised of a flexible base strip having pairs of apertures spaced at intervals along its length and an elastic strip laced through the aperture pairs to secure a light socket between the base strip and the elastic strip.

2 Claims, 13 Drawing Figures

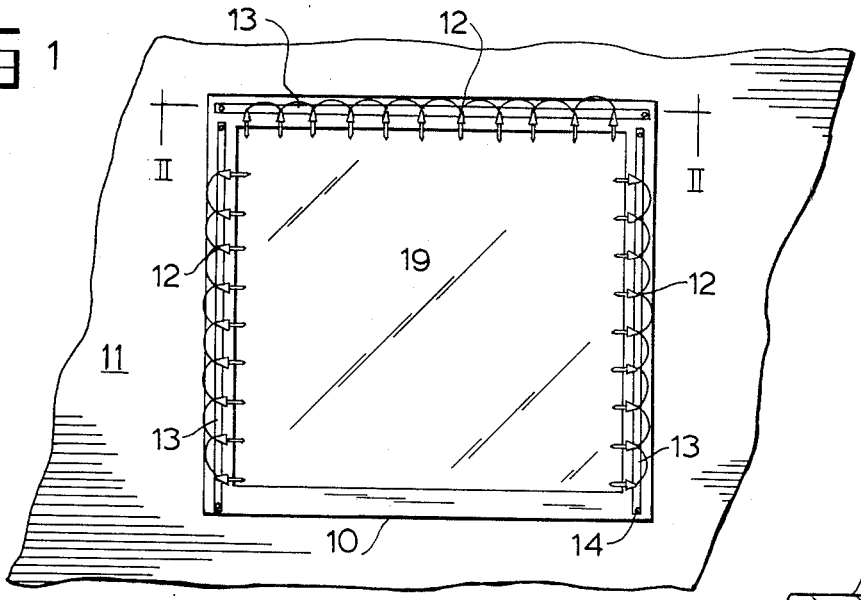
FIG 1
FIG 2
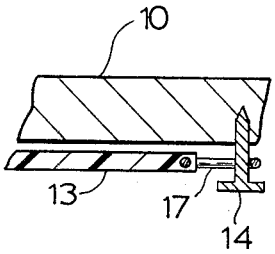
FIG 4
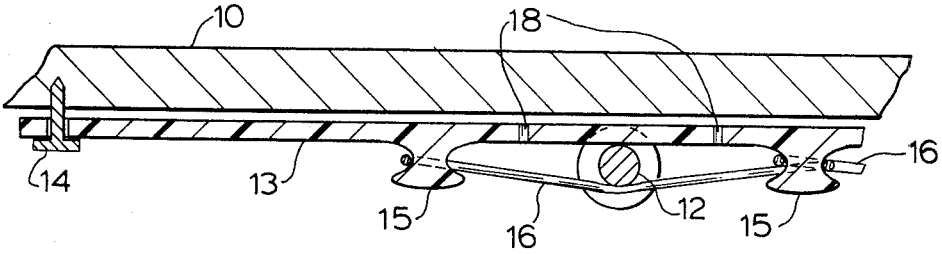
FIG 3
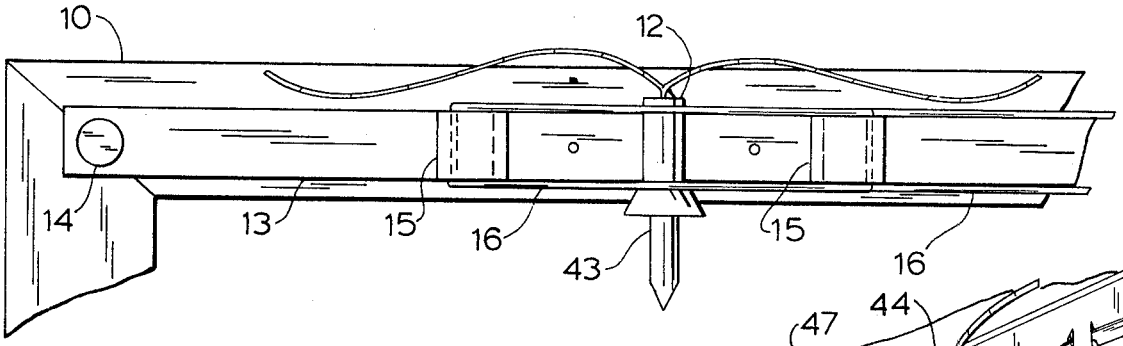
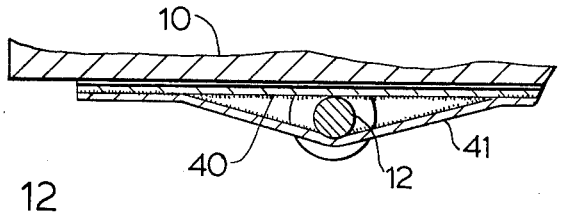
FIG 12
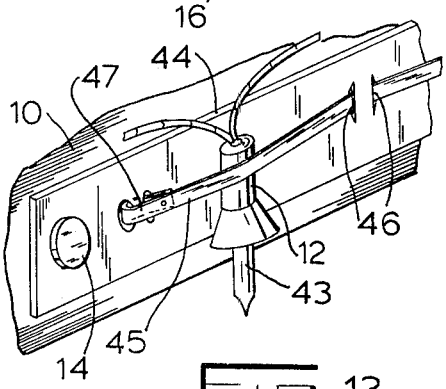
FIG 13

LIGHT MOUNTING TAPES

BACKGROUND OF THE INVENTION

1. Field of the Invention

The present invention relates to devices for displaying electric lamps in windows and elsewhere.

2. Description of the Prior Art

Non-flexible electric lamp display devices, such as U.S. Pat. No. 1,652,825 are known in the art. Such devices, however, do not possess the advantage of being able to be mounted around irregularly shaped windows or eaves. Those devices also utilize metallic clips to hold the lights in place, rather than elastic bands or retaining strips.

Individual clips, such as that disclosed in U.S. Pat. No. 3,275,818 must be individually mounted and cannot be removed and stored with the lights remaining fixed therein.

A light socket retaining means such as U.S. Pat. No. 3,540,687 has a portion thereof which may be retained about and stored with the light sockets, but still requires individual mounts which receive the clip which must be individually affixed to the structure to be illuminated.

SUMMARY OF THE INVENTION

The present invention provides a flexible means for mounting strings of decorative lights on a structure to be illuminated. The flexible nature of the mounting means allows mounting on irregularly shaped structures, and also provides a mounting means which can be removed and stored with the decorative lights still mounted thereto, thereby eliminating the necessity for individually mounting and removing each light socket every time the decorations are employed.

A first embodiment is comprised of a flexible tape which has extruded flanged ribs spaced at equal intervals along one side thereof. An elastic band is stretched between adjacent ribs so as to press a light socket placed between the ribs against the tape to hold the socket in place. A second embodiment also utilizes the ribbed tape but has a strip having longitudinal slits disposed therein coordinated to receive the ribs on the tape, so that when forced over the ribs the strip will retain light sockets between adjacent ribs substantially immovably in place.

A third embodiment is comprised of a flexible tape having a plurality of knobs disposed at equal intervals along one side of its length. Each knob has a rounded head which may be forced through a strip having holes disposed therein coordinated to receive the rounded heads such that the strip will secure a light socket between adjacent knobs immovably in place.

A fourth embodiment of the invention is comprised of two strips carrying pile type fasteners, one strip having hooks on one side thereof, and a second strip having loops on one side thereof. Decorative light sockets may be placed between the strips at any desired position, and the strips pressed together on either side of each socket to hold the socket in place.

A fifth embodiment has a flexible base strip, which may be mounted to the structure to be illuminated, which has a plurality of pairs of adjacent apertures disposed at equal intervals along the length thereof. An elastic strip is attached to one end of the base strip and is laced through the pairs of apertures. A light socket between adjacent pairs of apertures may thus be held immovably in place between the base strip and the elastic strip.

BRIEF DESCRIPTION OF THE DRAWINGS

FIG. 1 is a plan view of a window surrounded by decorative lights mounted by means of the present invention.

FIG. 2 is a sectional view taken on lines II—II of FIG. 1.

FIG. 3 is an elevational view of a first embodiment of the invention.

FIG. 4 is a sectional view of a means for mounting the invention to a window frame.

FIG. 12 is a side view of a fourth embodiment of the present invention.

FIG. 13 is a perspective view of a fifth embodiment of the present invention.

DESCRIPTION OF THE PREFERRED EMBODIMENTS

Figure 5:
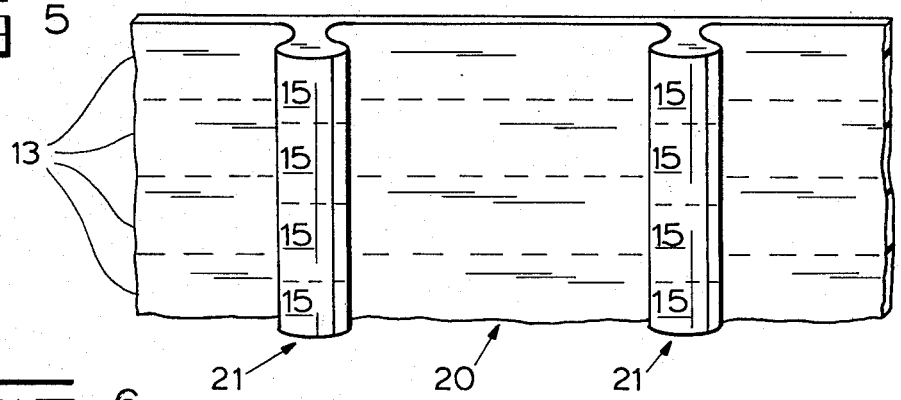
FIG. 5 is a perspective view of extruded stock from which the strips of FIGS. 2 and 3 may be cut.
Figure 6:
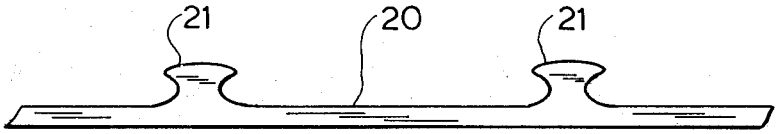
FIG. 6 is a side view of the extruded stock of FIG. 5.

It has become customary during the Christmas season to decorate one's house with strings of ornamental electric lights. The lights are generally displayed so as to border windows or outline various portions of one's house, such as the porch or eaves. Such decorations are ordinarily not left in place during the entire year, and must be installed at the beginning of the holiday season and removed thereafter. It is desirable to have a mounting means for such lights which may be quickly and easily installed and removed, and which results in minimal defacing of the woodwork to which it is attached.

In accordance with the present invention, a window 19 mounted in a wall 11 surrounded by strings of decorative lights 12 is shown in FIG. 1. The lights 12 are mounted on a window frame 10 by means of mounting strips 13.

A first embodiment of the mounting strip 13 is shown in FIG. 2. The strip 13 has a plurality of flanged ribs 15 extruded therefrom. A type of stock material from which the strip 12 may be made is shown in FIG. 5. An initially sheet-form piece of plastic stock 20 is subjected to a process whereby a plurality of ribs 21 are extruded therefrom. The stock 20 may then be cut into a plurality of strips 13 of desired width.

As shown in FIGS. 2 and 3, a retaining band 16 is looped around adjacent flanged ribs 15 so as to press a light socket 12 disposed between the ribs 15 against the tape 13. The retaining band 16 may be comprised of elastic, rubber, or other suitable material capable of pressing the light socket 12 tightly between the retaining band 16 and the strips 13. As shown in FIG. 3, the light socket 12 is held beneath the retaining band 16 such that the light 43 extends inside the window frame 10. The socket 12 may, however, be disposed in any desired manner.

A plurality of apertures 18 receive nails or tacks 14 to secure the tape 13 to the window frame 10.

A second means of affixing the strip 13 to the window frame 10 is shown in FIG. 4, wherein a loop 17 is attached to the end of the strip 13, through which a nail or tack 14 may be hammered.

Figure 7:
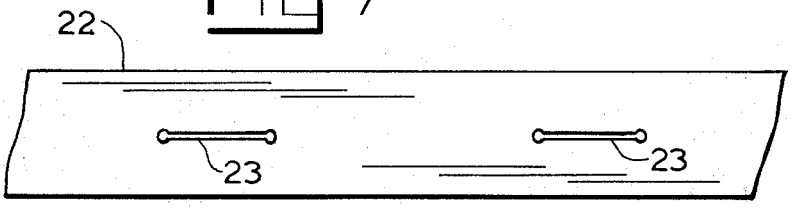
FIG. 7 is an elevational view of a retainer strip utilized in a second embodiment of the invention.
Figure 8:
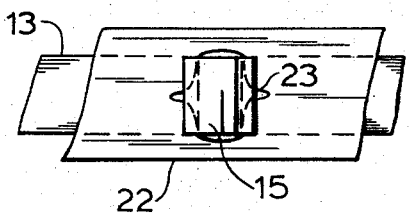
FIG. 8 is an elevational view of a second embodiment of the invention.
Figure 9:
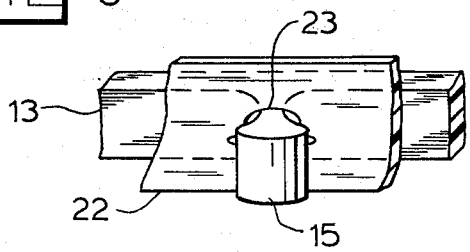
FIG. 9 is a perspective view of a second embodiment of the invention.

A second embodiment of the invention is shown in FIGS. 7, 8, and 9. FIG. 7 shows a retaining strip 22 having slits 23 longitudinally disposed along a central axis thereof. The slits 23 may be opened to force the retaining strip 22 over the ribs 15. A light socket 12 placed between adjacent ribs 15 may thereby be held substantially immovably in place by the retaining strip 22 pressing the socket 12 tightly against the strip 13. The slits 23 are of such a size that a degree of vertical force is necessary to disengage the slit 23 from the rib 15, such that accidental disengagement or loosening is unlikely.

Figure 10:
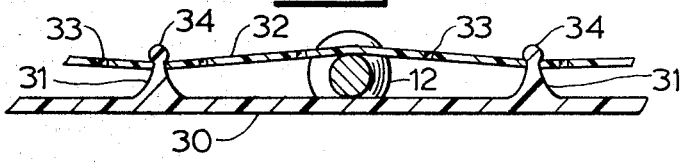
FIG. 10 is a side view of a third embodiment of the present invention.
Figure 11:
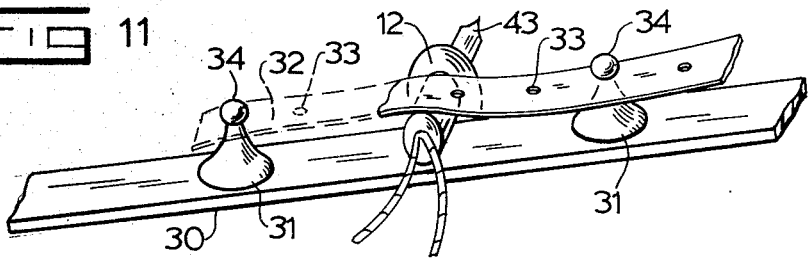
FIG. 11 is a perspective view of a third embodiment of the present invention.

A third embodiment of the invention is shown in FIGS. 10 and 11. A tape 30 has a plurality of knobs 31 spaced at equal intervals along a longitudinal axis on one side of the strip 30. The knobs 31 have rounded head 34. A retaining strip 32 has a plurality of holes 33, the holes 33 being spaced to coordinate with the spacing of the knobs 31 on the tape 30. The rounded head 34 of the knob 31 may be forced through a corresponding hole 33 in the retaining strip 32. A light socket 12 disposed between two adjacent knobs 31 is thus held substantially immovably in place as it is pressed between the tape 30 and the retaining strip 32. The holes 33 are of such a size that a vertical force is necessary to remove the retaining strip 32, making accidental disengagement of the strip 32 from the knobs 31 unlikely.

A fourth embodiment of the invention is shown in FIG. 12. A pair of tapes 40 and 41 are engageable by means of pile type fasteners carried thereon. One of the tapes 40 or 41 carries the fastener hooks, while the other carries the fastener loops. A light socket 12 may be selectively placed anywhere between the strips 40 and 41 and held immovably in place by interlocking the hooks and loops by pressing the strips 40 and 41 together as close as they will permit on either side of the socket 12. Whichever of the tapes 40 or 41 is adjacent the window frame 10 may be secured thereto by means identical to those employed in the first embodiment.

A fifth embodiment of the invention is shown in FIG. 13. A flexible base strip 44 is mounted to the window frame 10 or other structure by means of a nail or tack 14, or any other suitable means. The base strip 44 has a plurality of pairs of apertures 46 spaced at equal intervals along its length. Although the apertures 46 are shown in FIG. 13 to be slits, it will be understood that apertures of any suitable shape may be employed. An elastic strip 45 is secured at one end 47 to the base strip 44. The end of the elastic strip 45 may simply be tied around a pair of apertures 46, or, as shown in FIG. 13, an end 47 of the strip 45 may be doubled over and stitched to the base strip 44. The elastic strip 45 is then laced through each pair of apertures 46 such that substantial intervals of the elastic strip 45 are exposed on one side of the base strip 44.

A light socket 12 carrying a light 43 placed between adjacent pairs of apertures 46 will thus be held immovably in place between the elastic strip 45 and the base strip 44. The elastic strip 45 may be adjusted to provide sufficient tension to hold the socket 12 immovably in place.

Although various modifications might be suggested by those versed in the art, it should be understood that I wish to embody within the scope of the patent warranted hereon all such modifications as reasonably and properly come within the scope of my contribution to the art.

I claim as my invention:

1. A mounting device for electric light sockets adapted to be strung along window frames and the like to position light bulbs in the sockets projecting transversely from the device for display in the window which comprises:

an elongated flexible plastic tape;

a means for mounting the tape along a structure to be illuminated;

a plurality of extruded ribs transversely disposed at intervals on one side of said tape, each rib having a flattened flanged top;

a retainer strip releaseably mounted on said ribs having a plurality of longitudinal slits disposed along a longitudinal axis thereof in a pattern coordinated to receive said ribs in said slits; and said retainer strip cooperating with said ribs to define loops for draping over said sockets to press the sockets against the tape thereby securing the sockets transversely in the loops against shifting relative to the tape.

2. A mounting device for electric light sockets adapted to be strung along window frames and the like to position lightbulbs in the sockets projecting transversely from the device for display in the window which comprises:

an elongated flexible tape;

a means for mounting the tape along a structure to be illuminated;

a plurality of knobs mounted at equal intervals along a longitudinal axis on one side of said tape, said knobs each having a spherical head;

a retainer strip releasably mounted on said knobs having a plurality of holes therein in a pattern coordinated to receive said knobs in said holes; and said retainer strip cooperating with said knobs to define loops for draping over said sockets to press the sockets against the tape thereby securing the sockets transversely in the loops against shifting relative to the tape.

* * * * *